United States Patent [19]

Reimers

[11] Patent Number: 4,796,752

[45] Date of Patent: Jan. 10, 1989

[54] CART BAG FOR GOLF

[76] Inventor: Eric W. Reimers, 235 N. First St., Missoula, Mont. 59802

[21] Appl. No.: 127,809

[22] Filed: Dec. 2, 1987

[51] Int. Cl.[4] ..... A63B 55/00

[52] U.S. Cl. ..... 206/315.3; 206/315.6; 206/315.8

[58] Field of Search ..... 206/315.3, 315.5, 315.6, 206/315.7, 315.8

[56] References Cited

U.S. PATENT DOCUMENTS

| | | | |
|---|---|---|---|
| 2,006,920 | 7/1935 | Hotze | 206/315.8 X |
| 2,091,298 | 8/1937 | Agnew | 206/315.6 X |
| 2,422,218 | 6/1947 | Bauer | 206/315.8 X |
| 2,507,249 | 5/1950 | Dorazio | 206/315.8 |
| 2,855,967 | 10/1958 | Wycherley | 206/315.8 |
| 4,181,167 | 1/1980 | Ret | 206/315.6 |
| 4,266,589 | 5/1981 | Cochran | 206/315.5 X |
| 4,448,305 | 5/1984 | Sup | 206/315.8 |
| 4,709,814 | 12/1987 | Antonious | 206/315.6 |

FOREIGN PATENT DOCUMENTS

| | | | |
|---|---|---|---|
| 207317 | 11/1923 | United Kingdom | 206/315.5 |
| 370098 | 4/1932 | United Kingdom | 206/315.6 |

*Primary Examiner*—William Price

*Attorney, Agent, or Firm*—Michael J. Hughes

[57] ABSTRACT

A golf bag (10) is specifically adapted for use with powered or pull type carts and includes a rigid base plate (14), a rigid collar (18) including a peripheral frame (27) and a plurality of apertures (33, 34, 35 and 36) formed therethrough, a fabric tube (13) extending between the base plate (14) and the collar (18), and an internal support structure (22) to provide axial and radial support to the bag portion (12). The support structure (22) is in the form of a pair of elongated rigid rear stays (24) a pair of elongated rigid front stays (25) affixed within sockets (26) formed in the base plate (14) and the collar (18). The bag (10) further includes a carrying strap assembly (42) and a handle (44) to permit the user to easily carry the bag when not using a cart. The bag (10) is characterized by light weight, rigid shape, carrying comfort and low cost of manufacture and is of use to golfers of all types.

16 Claims, 3 Drawing Sheets

CART BAG FOR GOLF

TECHNICAL FIELD

The present invention relates generally to sporting goods and more specifically to golfing equipment.

BACKGROUND ART

Golf is a game that has been popular for centuries. Part of the game's appeal comes from the fact that it is a "life sport". That is, forced retirement due to age is rare. One reason for this is that the player can, to a large extent, control the amount of energy expended during a round of golf. The most significant variable controlling the amount of work necessary to complete a round of golf is whether or not the golfer carries his own bag. In fact, it is possible to nearly eliminate the work factor by utilizing power carts to transport the golfer and equipment to the ball position.

If a golfer does not wish to maximize his exercise, and hence chooses not to carry his own bag around the course, he will generally use a golf cart. The other possibility is to enlist the aid of a caddy, but apart from the professional tour, where carts are not allowed, caddies are rarely available. Therefore, the average golfer who chooses to, or due to physical limitations must, minimize his energy expenditure will indeed use a golf cart.

Two primary types of carts are utilized by golfers. The first of these is utilized to carry only the equipment (bag, clubs, scorecard, etc.), while the second type transports the golfer as well. The golfer transport carts are motorized, powered by reciprocating fossil-fuel engines or by electricity, while the equipment transport carts may be motorized but are usually pulled manually. The manual pull carts reduce the lifting strain on the golfer's back and shoulders but retain the benefits of walking the course.

Although walking and either carrying a bag or pulling a cart are desirable for exercise and aesthetics, and usually result in more rapid play (for inexplicable reasons), many courses, primarily for the purpose of increasing revenue, now require power golfer transport carts. Accordingly, it is no longer possible to play all courses without utilizing a cart.

In order to effectively transport a bag of clubs about a golf course, the cart must have means to hold the bag in an upright position. Otherwise, the clubs might too easily leave the bag inadvertently. Accordingly, most carts are provided with some simple bracket device providing a receptacle for the base of the bag and some cinching means to secure the upper portion of the bag, thereby allowing the bag to be secured in an upright position.

Most types of bags can be secured effectively onto a cart. However, when a bag not specifically adapted for a cart is used, disadvantages can arise. For instance, if a "soft" (flexible) bag is used, the top will collapse when cinched. This greatly reduces the volume of the bag, and makes it difficult to reinsert clubs after they are used. As the use of soft bags is quite widespread due to the fact that they are much lighter than rigid bags, this can be a significant disadvantage.

Alternatively, if a rigid bag is used, it will certainly be heavier than a soft bag. Since the bag spends much of its time on the cart, this in not as major a disadvantage; however, the bag does have to be carried from the golfer's cart to the cart and vice versa, and to and from storage as well. Furthermore, if it is desired to utilize a manual pull cart, then it is desirable to minimize weight, since dragging a heavy cart up a steep hill can be more exercise than the golfer might wish. Accordingly, many golfers own both light carry bags and enormous, bulky and heavy cart bags. Such golfers go through considerable effort transferring clubs between bags, depending on the course and mode of transport.

In view of the above, it is clear there is a need for a bag with characteristics of both soft and rigid bags. The prior art contains some devices fitting that general description. The "Lightweight Golf Bag" of *Clifford E. Cochran,* U.S. Pat. No. 4,266,589, issued May 12, 1981, is one such device. The Cochran device teaches a soft bag portion disposed within a rigid external frame assembly. A similar device is the "Golf Bag Including Stiffening Structure" of *Kim Y. Sup,* U.S. Pat. No. 4,448,305, issued May 15, 1984. Another example in the prior art is the "Collapsible Golf Bag" of *Young J. Suk,* U.S. Pat. No. 4,378,039, issued Mar. 29, 1983. Both the Sup and Suk devices disclose soft bag portions reinforced by internal frame assemblies.

A disadvantage of a device with external framework such as the Cochran device is that it is not aesthetically pleasing. A further disadvantage is that the bag is not "streamlined", so that when it does become necessary to carry the bag in close quarters, there are unnecessarily many projections from the bag to be snagged in obstacles.

A disadvantage of the Sup and Suk devices is that the frameworks disclosed are flexible in nature, thereby being susceptible to the crushing that occurs with an ordinary soft bag.

None of the devices in the prior art disclose the requisite light weight combined with some characteristics of rigidity that are desirable for a bag adapted to be used with a cart, a "cart bag". Further, the prior art is lacking in means to allow such bags to be balanced comfortably when being carried by the golfer.

DISCLOSURE OF THE INVENTION

Accordingly, it is an object of the present invention to provide a bag that is both lightweight and resistant to crushing when secured on a cart.

It is a further object of the present invention to provide a cart bag that can be easily and comfortably carried.

It is another object of the present invention to provide a bag which is optimal for use with both manual pull carts and power carts.

It is still another object of the present invention to provide a golf bag suitable for use on a cart while being properly balanced, using "peak" strap attachment and "valley" club insertion locations, to result in comfortable strap carrying and solid cart balancing.

It is a still further object of the present invention to provide a bag which is easily manufactured by utilizing separate component manufacturing and simple step assembly.

Briefly, a preferred embodiment of the present invention is a golf bag specifically adapted for use in conjunction with a golf cart of any type, i.e. a "cart bag". The bag includes a tubular bag portion, a base plate, and a collar. The bag portion is supported by an interior framework. The collar is uniquely angled to allow maximum area for club insertion and to better accommodate the storage of the shorter clubs. A plurality of webbings adjustably attaches a bag strap so that the balance point and orientation of the bag while being carried can be adapted to the individual who is using the bag.

An advantage of the present invention is that it provides a cart bag that will not be crushed when cinched to the bracket device of the cart.

A further advantage of the present invention is that it is adapted to have an adjustable balance point and carrying orientation.

Another advantage of the present invention is that the angled top allows easier club insertion and access to the shorter clubs.

A still further advantage of the invention is that the strap webbing passes through the divider portion of the collar, thus spreading the stress and improving the carrying balance and strap life.

Yet another advantage of the invention is that the angled collar provides club shaft compartments of varying depth such that "short shafted" clubs such as those used by juniors and women may avoid becoming "lost" in the interior of the bag, while retaining balance characteristics.

Still another advantage of the invention is that the interior frame structure allows dividers to be easily installed by wrapping about the stays, a much simpler construction process than interior sewing and which further results in a more durable divider assembly.

A still further advantage of the present invention is that it combines the best features of rigid superstructure bags with those of light flexible "soft" bags.

These and other objects and inventions will become clear to those skilled in the art in view of the description of the best presently known mode of carrying out the invention and the industrial applicability of the preferred embodiment as described herein and as illustrated in the drawings.

BEST MODE OF CARRYING OUT THE INVENTION

Figure 1:
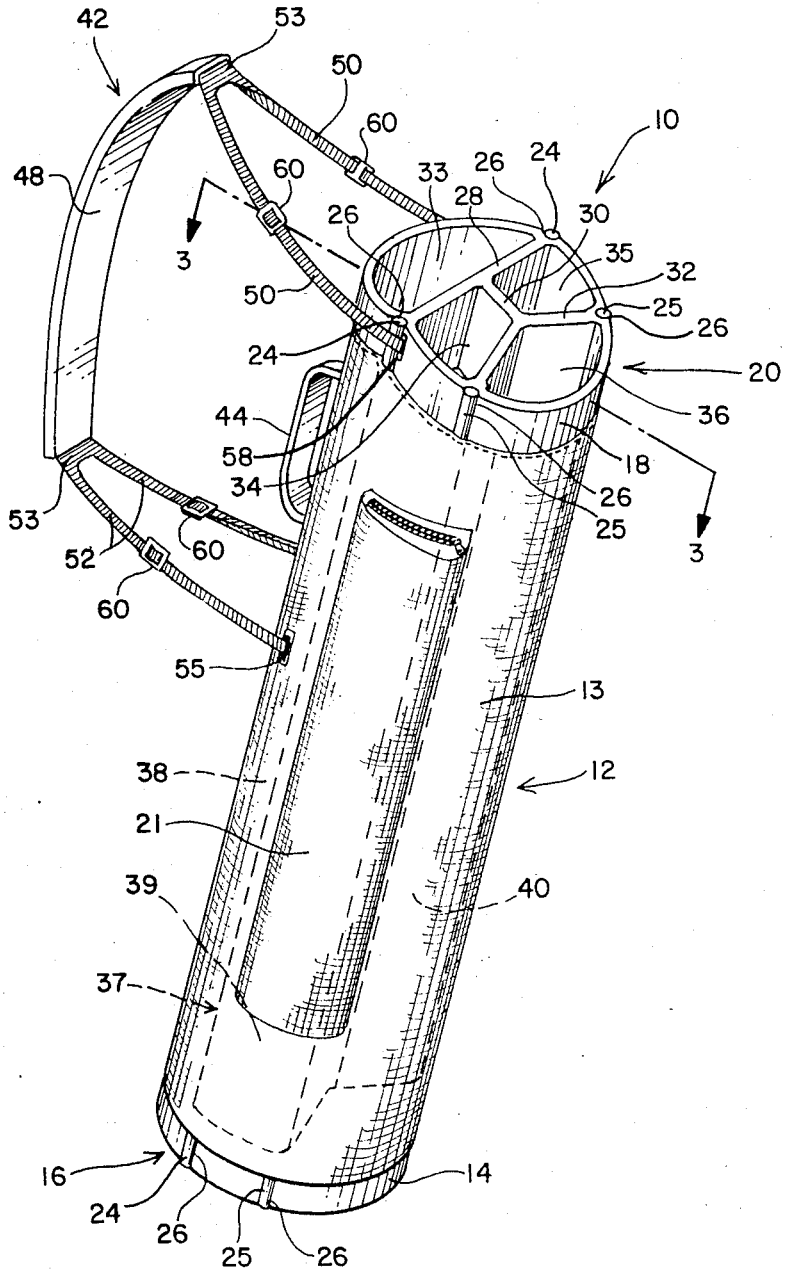
FIG. 1 is a perspective view of a preferred embodiment of a cart bag according to the present invention.
Figure 2:
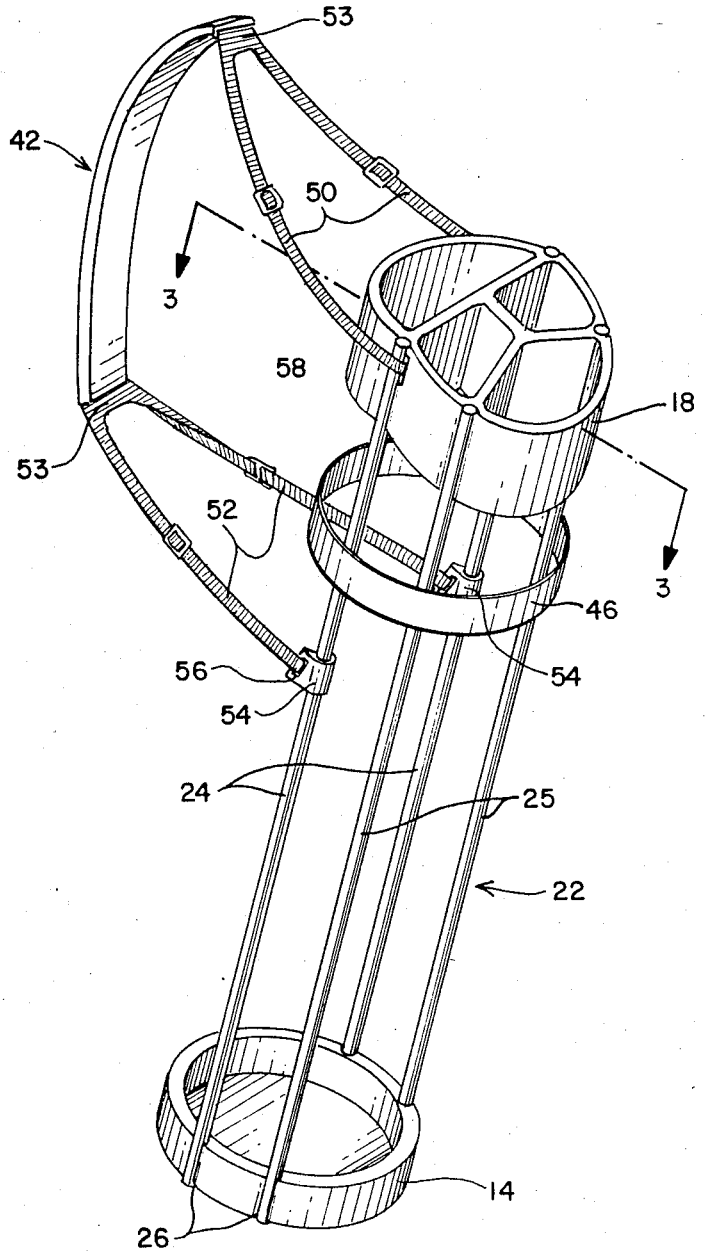
FIG. 2 is a perspective view of the support structure of the cart bag, shown with the bag portion removed.

The present invention is a golf bag specifically designed to be used in conjunction with any type of golf cart. A preferred embodiment of the invention is a cart bag 10 which is shown in perspective view in FIG. 1. The cart bag 10 includes a bag portion 12 including a fabric tube 13, a base plate 14 situated at a closed end 16, and a rigid collar member 18 situated at an open end 20. The bag 10 is in the general shape of an elongated cylinder. The bag portion 12 is provided with one or more storage pouches 21. The bag 10 includes an interior support structure 22 (see FIG. 2) in the form of a pair of complimentary rear stays 24, and a pair of complimentary front stays 25. The stays 24 are rigid elongated rods which are secured at one end to the base plate 14 and at the other to the collar 18. Due to the shape of the collar 18, the rear stays 24 are slightly longer than the front stays 25. The securing of the stays 24 and 25 to the base plate 14 and to the collar 18 is accomplished by inserting the stays 24 and 25 into molded sockets 26. The sockets 26 are formed integrally with the base plate 14 and the collar 18 with four sockets 26 being formed in each. The base plate 14 and the collar 18 are molded so that the stays 24 and 25 will be secured by a "snap fit" into the sockets 26, in that the sockets 26 envelop more than half the circumference of the stays 24. It is also possible to further secure the stays be set screws or the like, but this is not considered necessary in the preferred embodiment 10 since the structure of the collar 18 prevents inward collapse and the stretching of the fabric tube 13 and the fabric divider 37 provide constant interior radial force and prevent outward movement.

Figure 3:
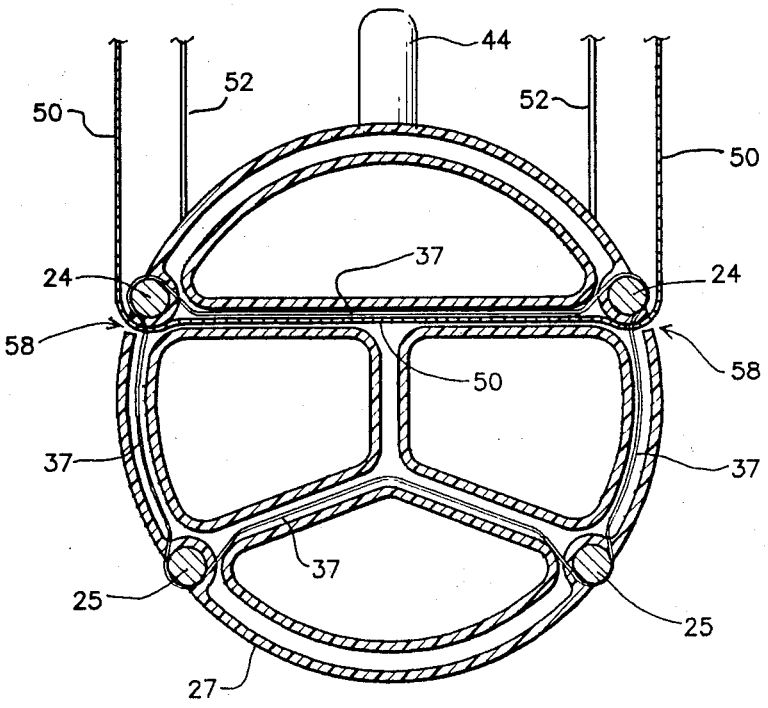
FIG. 3 is a cross sectional view taken along line 3—3 of FIG. 1 of the collar portion of the bag.
Figure 4:
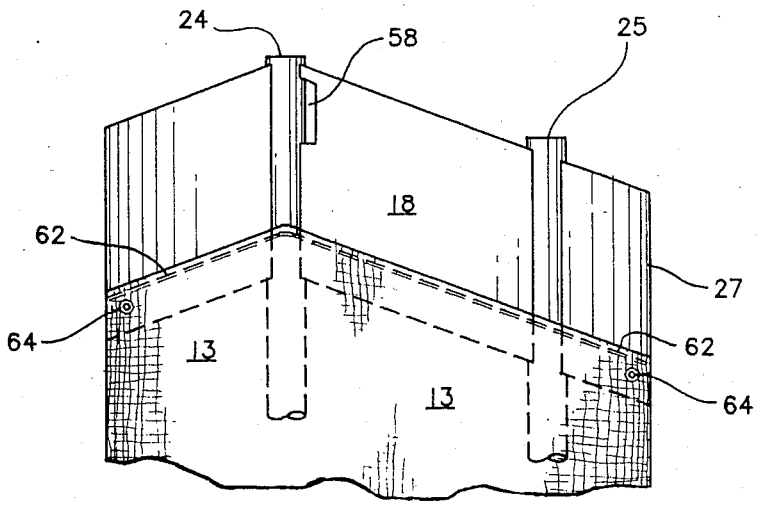
FIG. 4 is a side plan view of the collar member.

The collar 18, which is best illustrated in FIGS. 3 and 4, includes a circular peripheral frame 27, a first cross member 28, a second cross member 30, and a third cross member 32 which define a rear aperture 33, a left center aperture 34, a right center aperture 35 and a front aperture 36. The left and right center apertures 34 and 35 are separated from each other by the second cross member 30. Each of the frame 27 and the cross members 28, 30 and 32 are closed to the top but hollow to the bottom so as to form channels.

As shown especially in FIG. 4, the collar 18 is angled to a "peak" in the vicinity of the rear stays 24 and the first cross member 28 and slopes down to both the front and rear of this peak. Since the strap passes through the collar along this peak or ridge the weight is carried at the highest point of the bag, a decided advantage in carrying. Furthermore, the access points for the clubs are all below the height of the peak such that shorter shafted clubs are accessible in the compartments. This is especially notable in the front aperture 36 which is intended to receive short shafted clubs such as wedges and putters.

The apertures 33, 34, 35 and 36 provide access to the interior of the bag portion 12 so that the golfer may place clubs in the bag in an ordered ad separated fashion. In order to maintain this order and to prevent snagging of club handles within the bag body 12, it is desirable that the separation extend the entire length of the bag, and not be present merely at the point of entry. To this end, the preferred cart bag 10 includes an interior fabric divider 37 extending from the collar member 18 to the base 12, or nearly thereto.

The divider 37 is in the form of a flexible fabric tube which is stretched around the stays 24 and 25 to form a generally rectangular tube which divides the interior of the bag portion 12 into a rear compartment 38, a center compartment 39 and a front compartment 40. The compartments 38, 39 and 40 correspond with the apertures 33, 34, 35 and 36, which apertures provide access to the compartments. The upper edge of the fabric divider 37 is received within the hollow lower portions of the first cross member 28, the second cross member 30 and the appropriate zones of the peripheral frame 27 and is secured therein. This prevents snagging by club shafts and grips engaging the edge of the divider.

Although it is not considered necessary in the preferred embodiment 10, an optional center divider may be provided to extend within the third cross member 32 and from there downward between the sides of the divider 37. In most uses, however, the three compartment separation provided in the preferred embodiment is sufficient.

The collar member 18 is sharply angled, at approximately 20 degrees (see FIG. 4), about a line extending through the first cross member 28 and intersecting the pair of rear stays 24. This angling provides a larger opening for club insertion. Further, it allows for easier accommodation of shorter clubs, particularly ladies' clubs, without reducing overall bag length. This can be important when considering carrying balance.

The collar member 18 is of sufficient depth to provide a non-collapsible surface so that when the bag 10 is cinched into a golf cart, the cinch contacts the rigid collar 18, and the open end 20 of the bag 10 is not constricted. This maintains the interior volume of the bag 10 and allows for easy insertion/removal of clubs.

The cart bag 10 is carried either by means of a golf bag strap 42 or a handle 44. Generally, it is envisioned that the bag 10 will be carried by the strap 42, while the handle 44 will only be used for lifting. The handle 44 is attached at one end to the collar 18. The other end is attached to a support band 46. The support band 46 is a sturdy cylindrical member that is wrapped around the support structure 22.

The strap 42 consists of a padded portion 48, an upper webbing 50, and a lower webbing 52. The midpoint of the lower webbing 52 is attached to the lower end of the padded portion 48 at a specially designed T-member 53. The T-member 53 causes the lower webbing 52 to perpendicularly engage the padded portion 48, thus improving balance and minimizing twisting. The ends of the lower webbing 52 are passed through reinforced openings 55 and attached to the two rear stays 24. The attachment to the stays is accomplished by means of attachment fixtures 54. Both fixtures 54 are secured in place on the two rear stays 24 and provide a slot 56 that allows the lower webbing 52 to be attached to the stays 24 at an angle. This reduces the stress on the connection point.

The upper webbing 50 is in the form of a loop attached to the upper end of the padded portion 48 also at a T-member 53. The upper webbing 50 enters the collar 18 through an aperture 58 (See FIG. 4) at one end of cross member 28, runs along the open underside of cross member 28 (See FIG. 3), then exits the collar 18 through a corresponding aperture 58 at the other end of cross member 28. The upper webbing 50 passes around the rear stays 24, which provide extra support. This pass through provides broad strap support at the highest extend of the bag, a feature which maximizes carrying balance.

The length of both webbing 50 and 52 is made adjustable by providing excess material that is held at the desired length by means of slidable buckles 60. Adjustability of the webbings 50 and 52 is desirable so that an appropriate carrying balance can be achieved for all users and loads.

The attachment fixtures 54 are secured just above the longitudinal midpoint of the bag 10. This is done because the load in the bag 10 will ordinarily be top heavy. Most of the weight of golf clubs is in the head of the club. Therefore, attaching the lower webbing 52 above center allows the weight of the loaded bag 10 to be more properly distributed when it is being carried by a golfer. Weight distribution is of less consequence when the bag is secured to a cart. The adjustability of webbings 50 and 52 allows the golfer to change the balance point of the bag 10. Further, the upper webbing 50 slides freely through the apertures 58 and cross member 28 so that the bag 10 can be rotated to a comfortable position against the golfer's body when the golfer is carrying the bag 10. These capabilities mean that an optimal orientation of the bag 10 can be achieved regardless of the size of the golfer or the center of gravity of the load being carried.

FIG. 4 illustrates the angled shape of the collar member 18. This shape is of particular value in permitting optional accessibility of the golf clubs. The longer shafted clubs, such as woods, are provided more extensive shaft support while the shorter shafted clubs, short irons and putter, may still have the ends of the shafts above the collar 18, thus avoiding jarring directly applied to the club heads.

The method of attachment of the fabric tube 13 to the collar member 18 is also shown in FIG. 4. A pattern of stitching 62 follows the contour of the collar member 18 to provide an aesthetically pleasing appearance. Furthermore, the fabric tube 13 is secured to the collar member 18 by a plurality of rivets 64 which extend through the peripheral frame 27. The rivets prevent slippage.

In the preferred embodiment, the cart bag 10 is approximately 86 cm (34 in.) long. It is 22.2 cm (8.8 in.) in diameter. The collar 18 is 7.6 cm (3.0 in.) wide. The angle about cross member 28 is 20 degrees. The distance from the highest to the lowest points of the collar 18 is 11.4 cm (4.5 in.).

The fabric tube 13 is made of a durable fabric, usually nylon. The base plate 14 and the collar member 18 are molded rigid plastic. The stays 24 and 25 are rigid rods, usually aluminum, fiberglass, or steel. The webbings 50 and 52 can be any flexible material, but are usually nylon straps 2.5 cm (1.0 in.) wide.

Those skilled in the art will readily observe that numerous modifications and alterations of the device may be made while retaining the teachings of the invention. Accordingly, the above disclosure is not intended as limiting. The appended claims are therefore to be interpreted as encompassing the entire spirit and scope of the invention.

INDUSTRIAL APPLICABILITY

The cart bag 10 of the present invention is a lightweight bag specifically adapted to be used in conjunction with a golf cart. The lightweight bag portion 12 combined with the rigid support structure 22 yields the unique combination of a bag that will not be constricted when strapped to a cart, yet is very easy to carry. These characteristics make the cart bag 10 ideal for the golfer who plans to make use of a golf cart.

Further, the manufacture of the cart bag 10 is relatively easy and inexpensive. This means that it will enjoy an advantageous economic position on the market, and the golfing equipment market is indeed very large. Every pro shop and sporting goods store in the country is a potential carrier. Therefore, it is envisioned that the cart bag 10 of the present invention will enjoy widespread commercial utility and industrial applicability.

I claim:

1. A golf bag device, specifically adapted for being carried on a powered or pull type cart device, comprising:

a bag portion generally in the form of an elongated hollow cylinder; and carrying means for enabling a user to lift and carry the bag portion;

wherein, the bag portion includes:

a base plate;

a collar including a peripheral frame and a plurality of apertures formed axially therethrough for receiving the shafts of golf clubs;

a plurality of rigid elongated stays extending axially from the peripheral portion of said base plate to the peripheral portion of said collar, said stays maintaining axial separation between said base plate and said collar;

a flexible tube stretched about the radial exterior of said stays and being attached to said base plate and said collar so as to form therewith said elongated hollow cylinder, with said stays situated within said cylinder; and wherein the carrying means is in the form of a strap assembly attached both to said collar and to points on one or more of said stays axially displaced from said collar, such that said strap assembly is situated in the rear of the bag, said strap assembly including an upper webbing having a loop which passes through a cross member formed in said collar, a padded portion for receiving the golfer's shoulder during carrying, attached to said upper webbing, and a lower webbing extending downward from said padded portion and being attached to one or more of said stays.

2. The golf bag of claim 1 wherein the carrying means further include a handle affixed to a support band situated within said flexible tube in the rear of the bag at a position nearer said collar than said base plate.

3. The golf bag of claim 1 wherein said collar is formed such that the upper surface thereof is angled to include a downward sloping rear portion, a peaked ridge, and a downward sloping front portion, with a first cross member extending across said collar along said peaked ridge.

4. The golf bag of claim 1 wherein said collar is formed such that the upper surface thereof is angled to include a downward sloping rear portion, a peaked ridge, and a downward sloping front portion, with a first cross member extending across said collar along said peaked ridge; and said first cross member includes a slot to permit passage therethrough of said loop of said upper webbing.

5. The golf bag of claim 3 wherein said collar further includes a second cross member forward of said first cross member and a third cross member extending between said first and second cross members, said first, second and third cross members forming, together with said peripheral frame, a rear aperture, a left center aperture, a right center aperture and a front aperture.

6. The golf bag of claim 5 and further including a plurality of divider elements extending axially within said hollow cylinder to isolate the shafts of golf clubs inserted through one of said apertures from the shafts of golf clubs inserted through each other of said apertures.

7. The golf bag of claim 1 and further including a plurality of divider elements extending axially within said hollow cylinder to isolate the shafts of golf clubs inserted through one of said apertures from the shafts of golf clubs inserted through each other of said apertures.

8. The golf bag of claim 1 wherein said collar includes a plurality, equal in number to the number of said stays, of sockets to receive therein the upper ends of respective ones of said stays.

9. The golf bag of claim 8 wherein said sockets are in the form of depressions formed in the exterior of said peripheral frame to receive the upper ends of said stays in a snap-fit manner.

10. The golf bag of claim 8 wherein said base plate includes a further plurality of said sockets for receiving the lower ends of respective ones of said stays.

11. The golf bag of claim 1 wherein said plurality of elongated rigid stays includes a pair of rear stays and a pair of front stays.

12. The golf bag of claim 5 wherein said plurality of elongated rigid stays includes a pair of rear stays and a pair of front stays.

13. The golf bag of claim 12 wherein said rear stays are restrained within said sockets situated at the respective ends of said first cross member, rearward of said slot; and said front stays are restrained within said sockets situated at the respective ends of said second cross member.

14. The golf bag of claim 1 and further including one or more storage pouches attached to the exterior surface of said flexible tube.

15. In a golf bag device including a rigid base plate, a rigid collar, and a flexible tube portion, the improvement comprising:

providing a rigid support structure extending between the base plate and the collar and within the tube portion, the support structure being in the form of a plurality of elongated rigid stays dispersed about the periphery of the bag so as to prevent axial and radial collapse of said flexible tube portion; and forming the collar in an angled manner so as to include an exteriorally downward sloping rear portion, a peaked ridge and an exteriorally downward sloping front portion, such that the axial distance between the base plate and the top surface of the collar is at its maximum at said peaked ridge and progressively decreases to the front and the rear of said peaked ridge.

16. The improvement of claim 15 wherein said plurality of rigid stays includes a pair of front stays and a pair rear stays.

* * * * *